US009087665B2

(12) United States Patent
Fong et al.

(10) Patent No.: US 9,087,665 B2
(45) Date of Patent: Jul. 21, 2015

(54) CIRCUIT BREAKER ELECTRICAL CONTACT ASSEMBLY, AND SYSTEMS AND METHODS USING SAME

(75) Inventors: Sheenfar Sean Fong, Lawrenceville, GA (US); Jorg Sizemore, Duluth, GA (US); Mark I. Shmukler, Duluth, GA (US); James Edward Ferree, Lawrenceville, GA (US)

(73) Assignee: Siemens Aktiengesellschaft, München (DE)

( * ) Notice: Subject to any disclaimer, the term of this patent is extended or adjusted under 35 U.S.C. 154(b) by 380 days.

(21) Appl. No.: 13/576,460

(22) PCT Filed: Feb. 8, 2011

(86) PCT No.: PCT/US2011/024016

§ 371 (c)(1),
(2), (4) Date: Aug. 1, 2012

(87) PCT Pub. No.: WO2011/097612

PCT Pub. Date: Aug. 11, 2011

(65) Prior Publication Data

US 2012/0298489 A1 Nov. 29, 2012

Related U.S. Application Data

(60) Provisional application No. 61/302,273, filed on Feb. 8, 2010, provisional application No. 61/302,278, filed on Feb. 8, 2010.

(51) Int. Cl.

| | |
|---|---|
| ***H01H 1/50*** | (2006.01) |
| ***H01H 77/10*** | (2006.01) |
| ***H01H 1/22*** | (2006.01) |

(52) U.S. Cl.

CPC ..... *H01H 77/104* (2013.01); *H01H 1/226* (2013.01); *H01H 1/50* (2013.01)

(58) Field of Classification Search

CPC ..... H01H 1/50; H01H 73/00; H01H 71/10; H01H 71/1072; H01H 71/02; H01H 71/12; H01H 71/2481; H01H 71/52; H01H 71/528; H01H 75/00; H01H 77/00; H01H 79/00; H01H 81/00; H01H 2003/032

USPC ..... 200/250, 49, 50.01, 50.21, 408–410, 200/441, 553, 554, 244; 218/32, 146; 335/8, 196

See application file for complete search history.

(56) References Cited

U.S. PATENT DOCUMENTS

| | | | | |
|---|---|---|---|---|
| 4,644,120 | A * | 2/1987 | Tedesco | 200/401 |
| 5,899,323 | A | 5/1999 | Rakus | |
| 8,420,969 | B2 * | 4/2013 | Marushima et al. | 200/400 |

FOREIGN PATENT DOCUMENTS

| | | |
|---|---|---|
| CN | 1185639 A | 6/1998 |
| DE | 3901852 A1 | 7/1990 |

(Continued)

OTHER PUBLICATIONS

Translation of Chinese Office Action mailed Aug. 6, 2014 corresponding to Chinese Application No. 201180016727.3 filed Feb. 8, 2011 (24 pages).

(Continued)

*Primary Examiner* — Edwin A. Leon
*Assistant Examiner* — Anthony R. Jimenez

(57) ABSTRACT

Embodiments provide an electrical contact assembly. The electrical contact assembly includes a crossbar, a pivot pin mounted in the crossbar, a contact arm pivotally mounted on the pivot pin and rotatable about a pivot axis, a moveable electrical contact spaced from the pivot axis in a first arm portion of the contact arm, and a spring assembly coupled between the crossbar and the contact arm, the spring assembly including a clevis pin and a spring received on the clevis pin wherein an end of the clevis pin extends through the spring and is received in a pivot recess in the crossbar. Electrical contact assemblies with offset rod ends and limit stops are also disclosed. Systems including the electrical contact assembly and methods of operating the electrical contact assembly are provided, as are other aspects.

20 Claims, 15 Drawing Sheets

(56) References Cited

FOREIGN PATENT DOCUMENTS

| | | | |
|---|---|---|---|
| DE | 10252741 | B3 | 2/2004 |
| EP | 0380012 | A1 | 8/1990 |
| EP | 0853327 | A2 | 7/1998 |
| GB | 1564412 | A | 4/1980 |

OTHER PUBLICATIONS

PCT International Search Report mailed Jun. 29, 2011 corresponding to PCT International Application No. PCT/US2011/024016 filed Feb. 8, 2011 (19 pages).

* cited by examiner

FIG. 3G
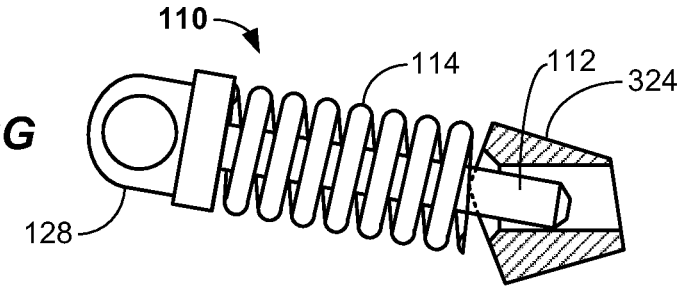
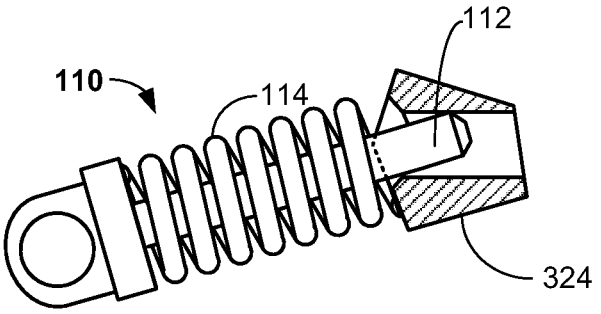
FIG. 3H
FIG. 3I
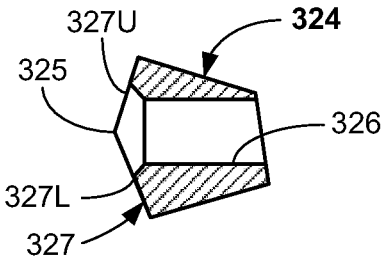

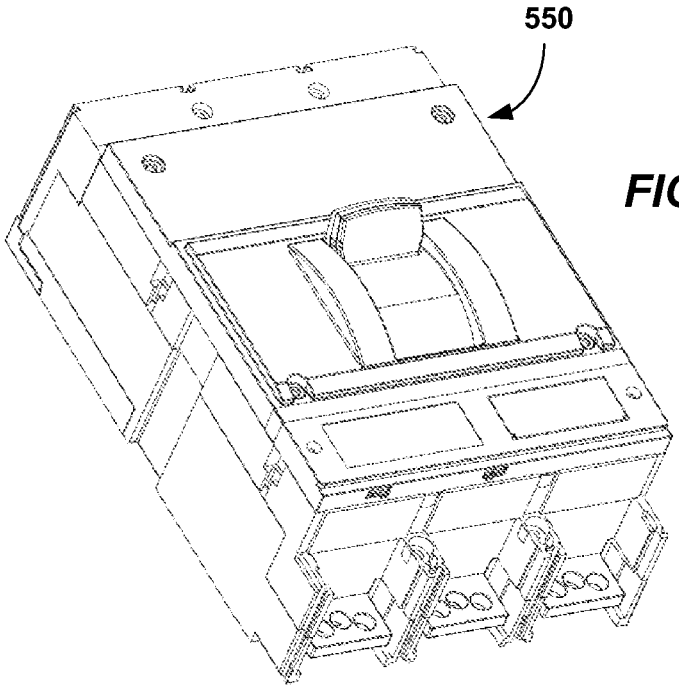
FIG. 5K
FIG. 5L
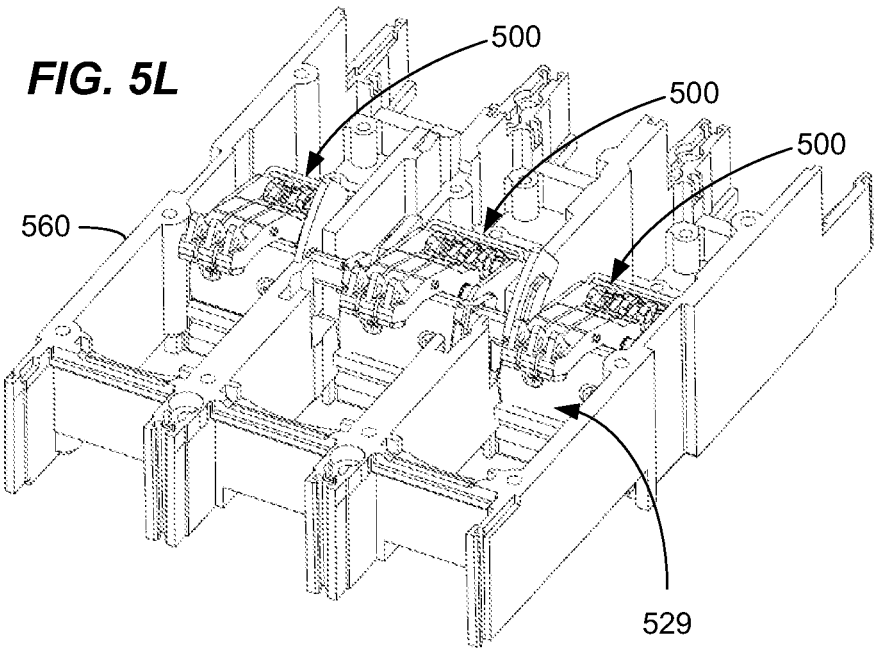

CIRCUIT BREAKER ELECTRICAL CONTACT ASSEMBLY, AND SYSTEMS AND METHODS USING SAME

RELATED APPLICATIONS

This application claims priority to U.S. Provisional Application Ser. No. 61/302,273 entitled "DIRECT COMPRESSION SPRING CONTACT SYSTEM" filed on Feb. 8, 2010, and U.S. Provisional Application Ser. No. 61/302,278 entitled "OFFSET CLEVIS PIN FOR DIRECT COMPRESSION SPRING. CONTACT SYSTEM" filed on Feb. 8, 2010, the disclosures of which are hereby incorporated by reference in their entirety herein.

FIELD OF THE INVENTION

The present invention relates generally to circuit breakers, and more particularly moveable electrical contact assemblies adapted to be used in circuit breakers.

BACKGROUND OF THE INVENTION

Within circuit breakers, one or moveable electrical contacts may be provided. Typically, such moveable electrical contacts are included on moveable contact arms that pivot relative to a circuit breaker housing. Generally, a spring biases the moveable contact to a closed configuration such that intimate contact is provided between a stationary contact and the moveable contact. Upon encountering a interruption event (e.g., an over current situation) that trips the circuit breaker, a cam-follower mechanism allows the contact arm to be repositioned relative to a pivot such that a spring load is applied to maintain the contact arm in an open position. However, such cam-follower mechanisms may lose contact pressure between the moving and stationary electrical contacts as the electrical contacts erode. Moreover, they may exhibit large frictional forces effectively making tripping more difficult.

Accordingly, there is a long-felt and unmet need for an electrical contact assembly that provides suitable contact pressure, has relatively low friction operation, and provides suitable forces to hold the contacts open upon encountering an interruption event.

SUMMARY OF THE INVENTION

In a first aspect, an electrical contact assembly is provided. The electrical contact assembly includes a crossbar; a pivot pin mounted in the crossbar; a contact arm pivotally mounted on the pivot pin and rotatable about a pivot axis; a moveable electrical contact spaced from the pivot axis on a first arm portion of the contact arm; and a spring assembly coupled between the crossbar and the contact arm as a connection location spaced from the pivot axis, the spring assembly including a spring and a clevis pin wherein an end of the pin extends through the spring and is received in a pivot recess in the crossbar.

In a system aspect, a circuit breaker is provided. The circuit breaker includes a circuit breaker body; a crossbar pivotally coupled to the circuit breaker body; a pivot pin mounted in the crossbar; a contact arm pivotally mounted on the pivot pin and rotatable about a pivot axis; a moveable electrical contact spaced from the pivot axis on a first portion of she contact arm; and a spring assembly coupled between the crossbar and the contact arm as a connection location spaced from the pivot axis, the spring assembly including a spring and a clevis pin wherein an end of the pin extends through the spring and is received in a pivot recess in the crossbar.

In a method aspect, a method of operating an electrical contact assembly is provided. The method includes providing a moveable contact arm pivotable relative to a crossbar about a pivot axis, the moveable contact arm including a first arm portion and a second arm portion; coupling a spring assembly to the second arm portion, the spring assembly including a spring and a clevis in wherein an end of the pin extends through the spring and is received in a pivot recess in the crossbar; and causing rotation of the moveable contact arm about the pivot axis upon encountering an interruption event, wherein rotation of the moveable contact arm causes a force vector acting on the spring assembly to cross over the pivot axis when moving from the moveable contact arm from a closed configuration to an open configuration thereby causing the end of the pin to pivot in the pivot recess.

In another aspect, an electrical contact assembly is provided. The electrical contact assembly includes a crossbar; a pivot pin mounted in the crossbar; a contact arm pivotally mounted on the pivot pin and rotatable about a pivot axis; a moveable electrical contact spaced from the pivot axis on a first arm portion of the contact arm; and a spring assembly coupled between the crossbar and the contact arm at a connection location spaced from the pivot axis, the spring assembly including a spring, a clevis pin including a axial axis, wherein an end of the clevis pin extends through the spring, a spring retainer coubled to the spring, and a rod end coupled to the contact arm, wherein the rod end is offset from the axial axis.

In another aspect, an electrical contact assembly is provided. The electrical contact assembly includes a crossbar; a pivot pin mounted in the crossbar; a contact arm pivotally mounted on the pivot pin and rotatable about a pivot axis; a moveable electrical contact spaced from the pivot axis on a first arm portion of the contact arm; and a spring assembly coupled between the crossbar and the contact arm at a connection location spaced from the pivot axis, the spring assembly including a spring, a clevis pin including an axial axis, wherein an end of the clevis pin extends through the spring, a spring retainer coupled to the spring, and a pivoting connector coupled to the contact arm; and a limit stop coupled to the crossbar, the limit stop adapted to limit a rotational motion of the contact arm, the limit stop being oriented to engage the contact arm on a side of the contact arm containing the moveable electrical contact, the limit stop having a curved surface adapted to move relative to a surface of a circuit breaker housing to operatively minimize arc debris from exiting an arc chamber of the circuit breaker housing.

Still other aspects, features, and advantages of the present invention may be readily apparent from the following detailed description by illustrating a number of exemplary embodiments and implementations, including the best mode contemplated for carrying out the present invention. The present invention may also be capable of other and different embodiments, and its several details may be modified in various respects, all without departing from the spirit and scope of the present invention. Accordingly, the drawings and descriptions are to be regarded as illustrative in nature, and not as restrictive. The invention is to cover all modifications, equivalents, and alternatives falling within the spirit and scope of the invention.

BRIEF DESCRIPTION OF DRAWINGS

FIGS. 3G and 3H are various side views of spring assemblies shown pivoted in an opened and closed configuration according to embodiments of the present invention.

FIG. 3I is a cross sectioned side view of a crossbar insert shown having a pointed ridge configuration according to embodiments of the present invention.

FIG. 5K is an isometric view of a circuit breaker including multiple spring assemblies according to embodiments of the present invention.

FIG. 5L is an isometric view of a circuit breaker housing including multiple electrical contact assemblies mounted therein according to embodiments of the present invention.

DETAILED DESCRIPTION

In view of the foregoing difficulties, and, in particular, the desire to provide suitable contact pressure, low friction tripping operation, and also provide suitable forces to hold the contacts open upon encountering an interruption event, an improved electrical, contact assembly is provided. Also provided is a circuit breaker including the improved electrical, contact assembly and a method of operating the same.

The contact assembly includes a crossbar, a pivot pin mounted in the crossbar, a contact arm pivotally mounted on the pivot pin and rotatable about a pivot axis, a moveable electrical contact spaced from the pivet axis on a first arm portion of the contact arm, and a spring assembly pivotally coupled between the crossbar and the contact arm at a connection location spaced from the pivot axis. The spring assembly includes a spring and a clevis pin wherein an end of the clevis pin extends through the spring and is received in a pivot recess in the crossbar. In some embodiments, the clevis pin may be received and pivot in a crossbar insert of the crossbar. The spring may be a coil spring and may be precompressed between a spring retainer of the spring assembly and a curved or pointed ridge portion of the crossbar insert. In some embodiments, the spring assembly may be mounted to the contact arm by an offset rod end.

As will become apparent, the electrical contact assembly of the present invention advantageously provides suitable contact closing pressure, relatively low friction forces to allow relatively unimpeded contact opening, and also suitable forces so maintain the contact arm in an opened configuration upon encountering an interruption event (e.g., after breaker tripping). Moreover, because the spring is fully supported along its length, longer springs may be used without buckling concerns, thereby providing relatively more linear contact engagement forces.

These and other embodiments of the electrical contact assembly, circuit breakers including one or more of the electrical contact assemblies and methods of operating the electrical contact assembly are described below with reference to FIGS. 1A-6. The drawings are not necessarily drawn to scale. Like numerals are used throughout to denote like elements.

Figure 1A:
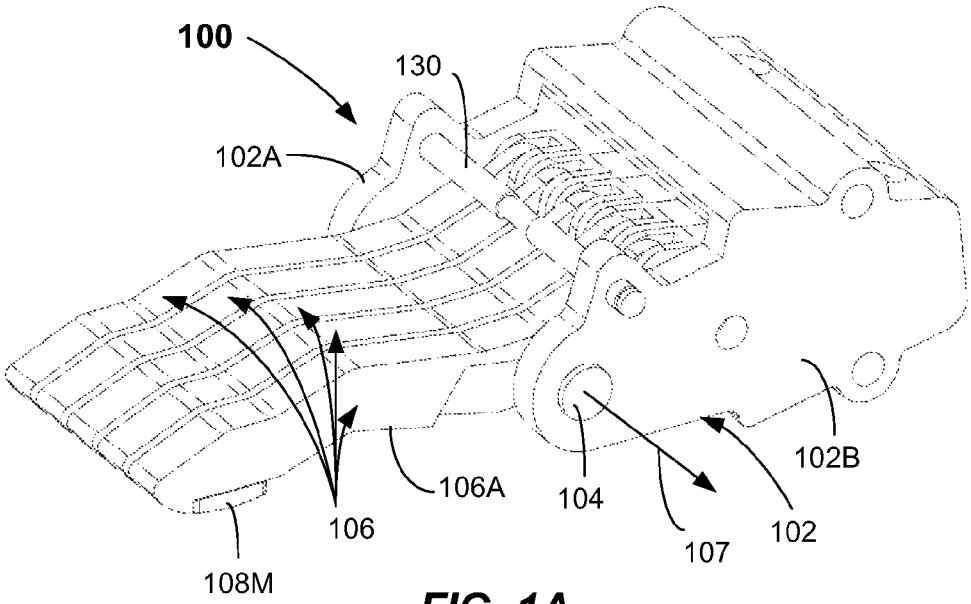
FIG. 1A is a perspective view of an electrical contact assembly according to embodiments of the present invention.
Figure 1B:
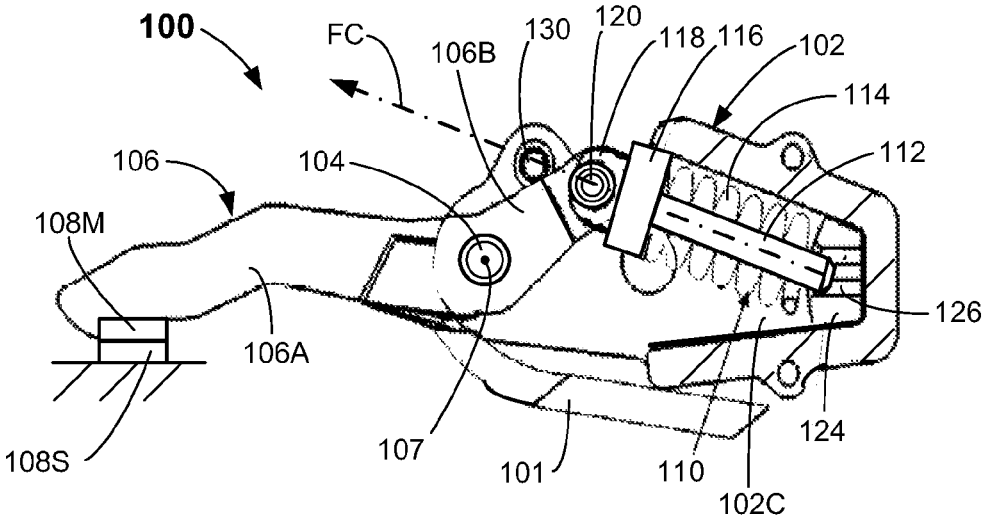
FIG. 1B is a partially cross sectioned side view of an electrical contact assembly according to embodiments of the present invention shown in a closed configuration.
Figure 1C:
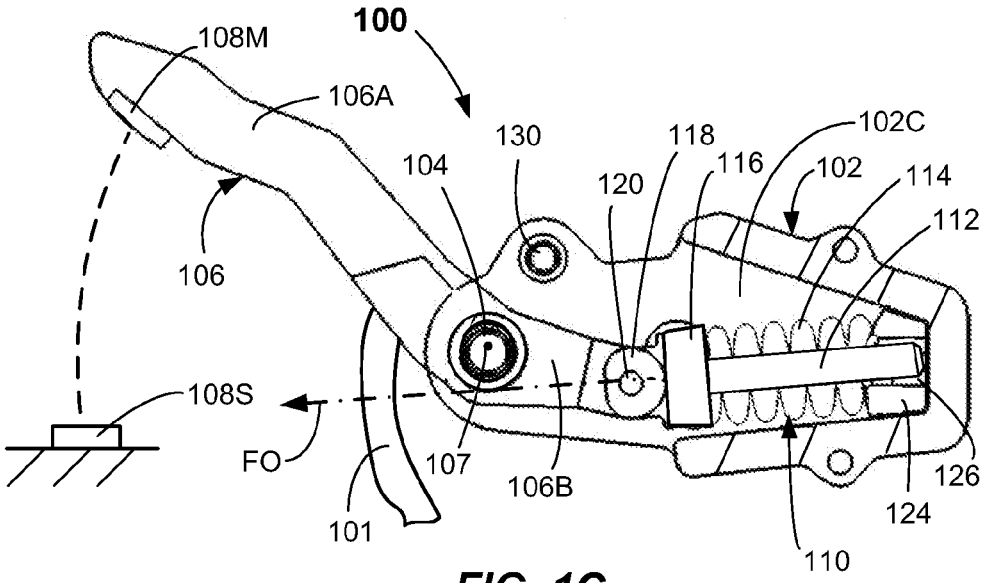
FIG. 1C is a partially cross sectioned side view of the electrical contact assembly according to embodiments of the present invention shown in an opened configuration.
Figure 5A:
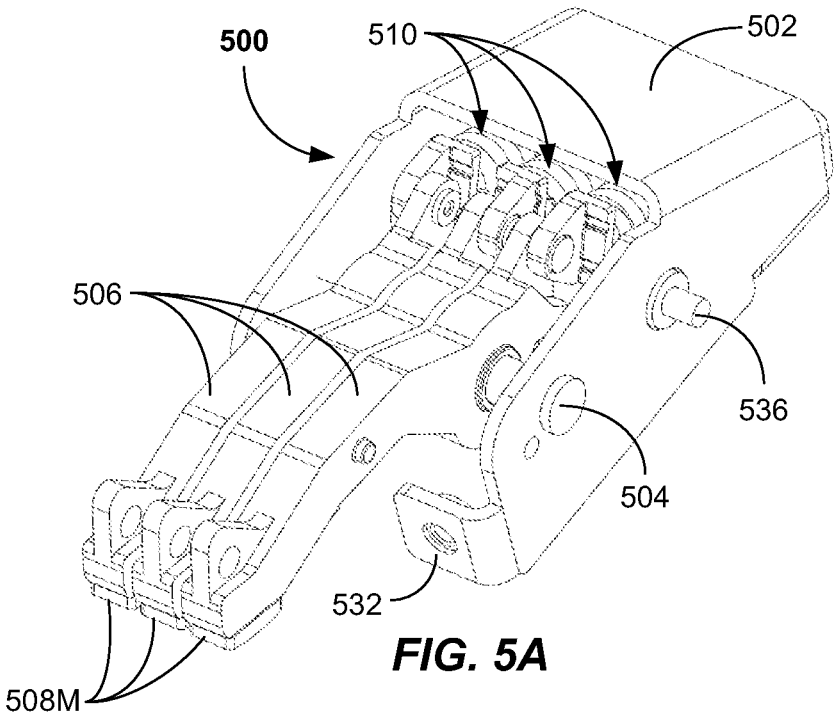
FIG. 5A is an isometric view of an alternate electrical contact assembly according to another embodiment of the present invention.
Figure 5B:
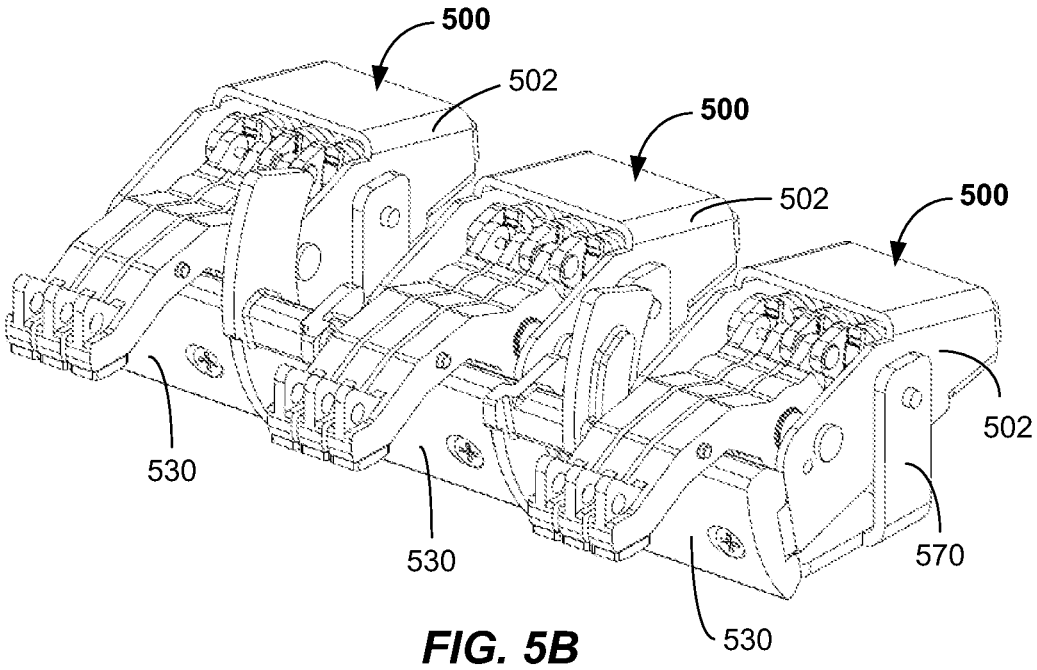
FIG. 5B is an isometric view of a multi-pole contact assembly including a plurality of electrical contact assemblies of FIG. 5A coupled in a side-by-side orientation according to another aspect of the present invention.
Figure 5C:
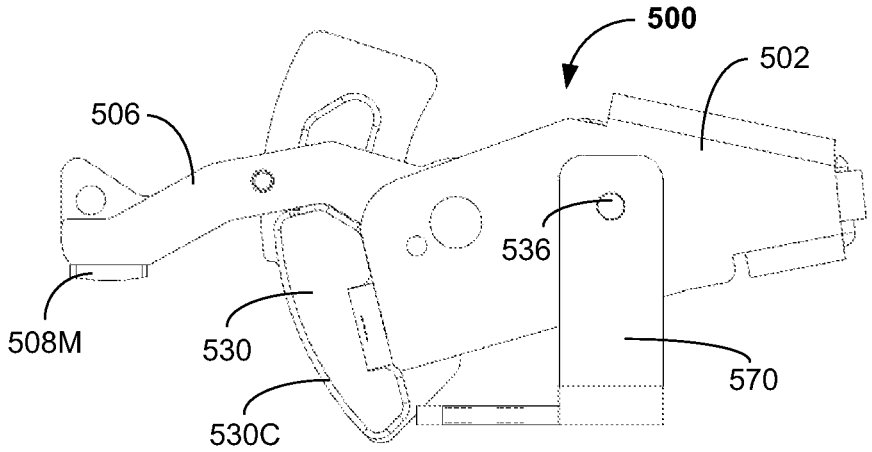
FIG. 5C is a side view of an electrical contact assembly shown in a closed (on) configuration according to embodiments of the present invention.
Figure 5D:
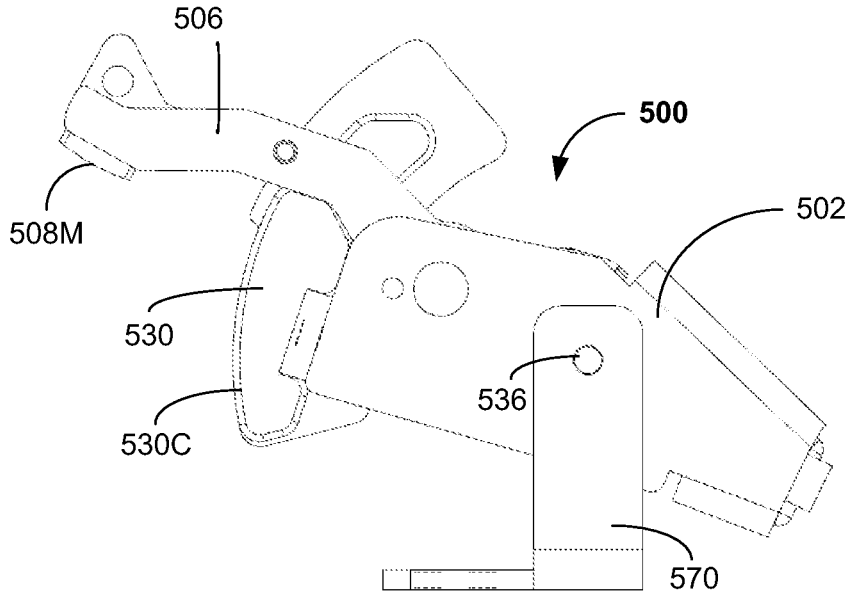
FIG. 5D is a side view of an electrical contact assembly in an open (off) configuration according to embodiments of the present invention.
Figure 5E:
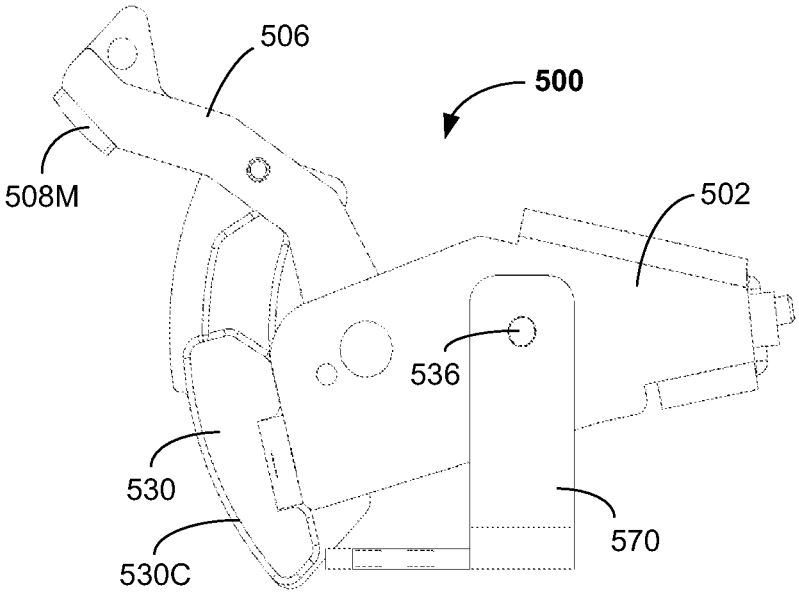
FIG. 5E is a side view of an electrical contact assembly shown in a blown open configuration according to embodiments of the present invention.
Figure 5F:
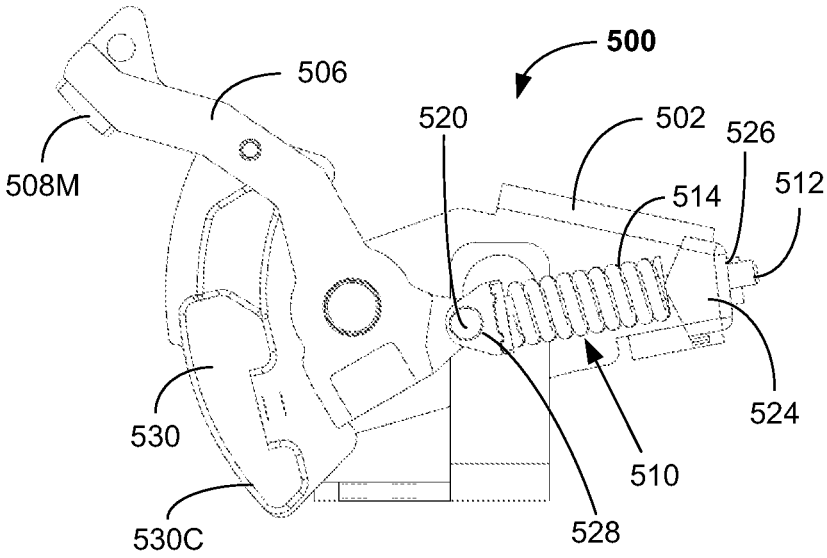
FIG. 5F is a partially cross sectioned side view of an electrical contact assembly shown in a blown open configuration illustrating the internal construction of the FIG. 5E embodiment.
Figure 5G:
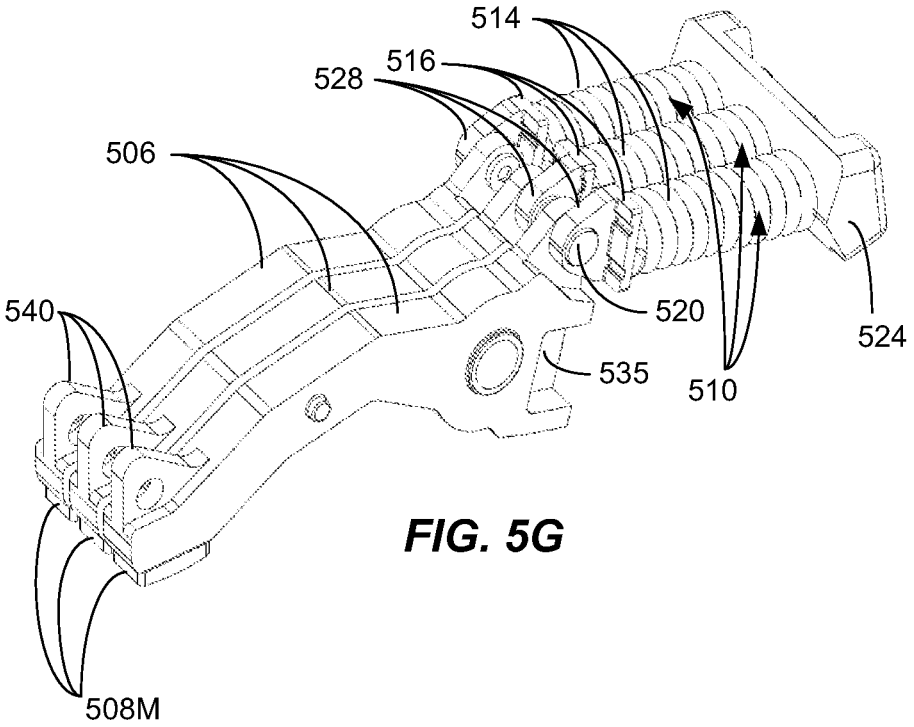
FIG. 5G is an isometric view of spring assemblies mounted between contact arms and a common crossbar insert of an electrical contact assembly according to embodiments of the present invention.
Figure 5H:
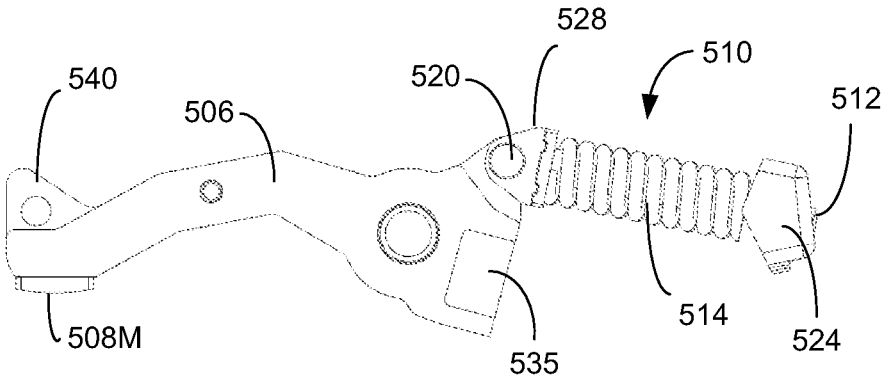
FIG. 5H is a side view of a spring assembly mounted between a contact arm and a crossbar insert of an electrical contact assembly according to embodiments of the present invention.
Figure 5I:
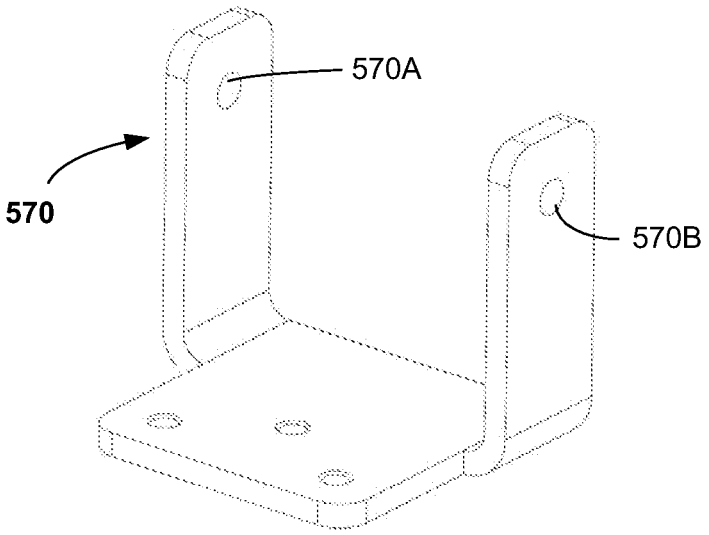
FIG. 5I is an isometric view of a bracket adapted to mount an electrical contact assembly to a circuit breaker housing according to embodiments of the present invention.
Figure 5J:
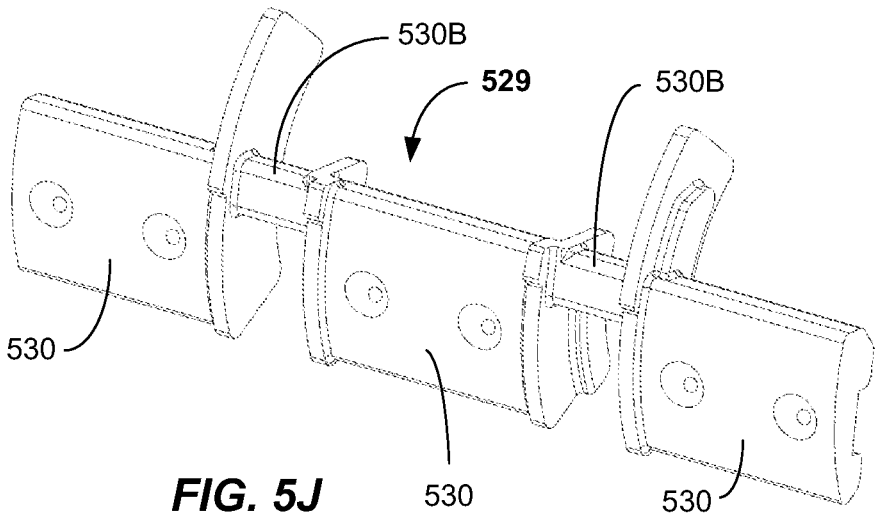
FIG. 5J is an isometric view of a limit stop assembly adapted to mount to a plurality of electrical, contact assemblies according to embodiments of the present invention.
Figure 5M:
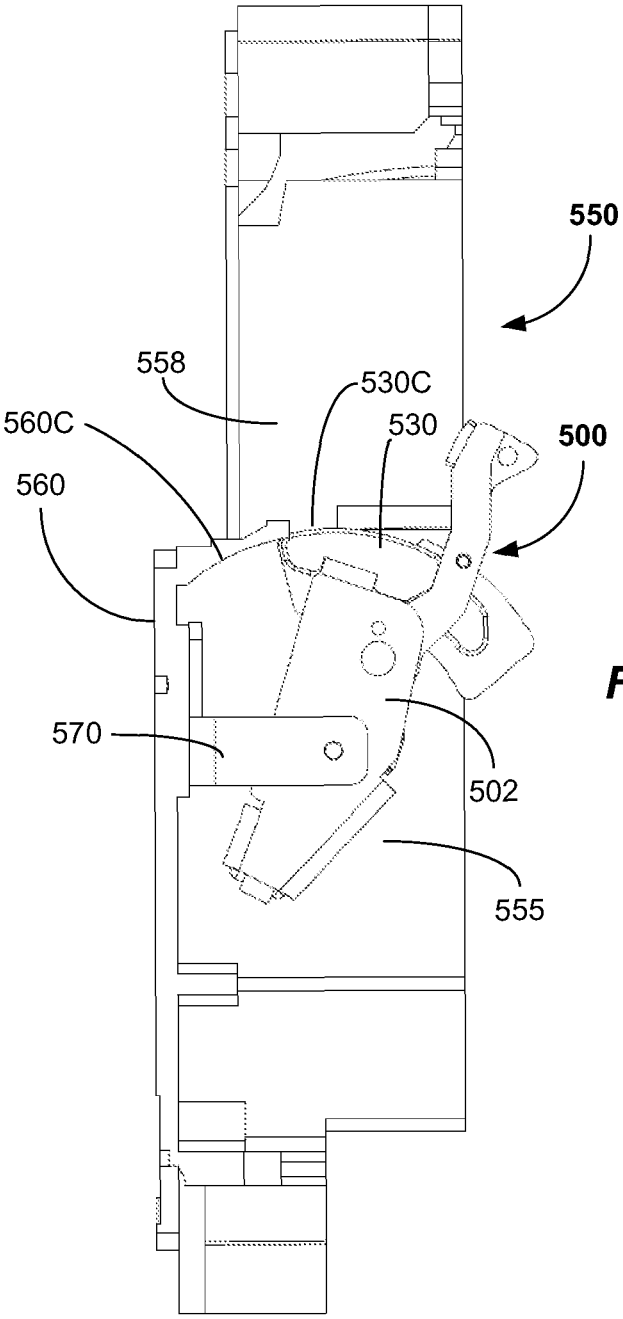
FIG. 5M is a cross sectioned side view of a circuit breaker housing including an electrical contact assembly mounted therein according to embodiments of the present invention.
Figure 5N:
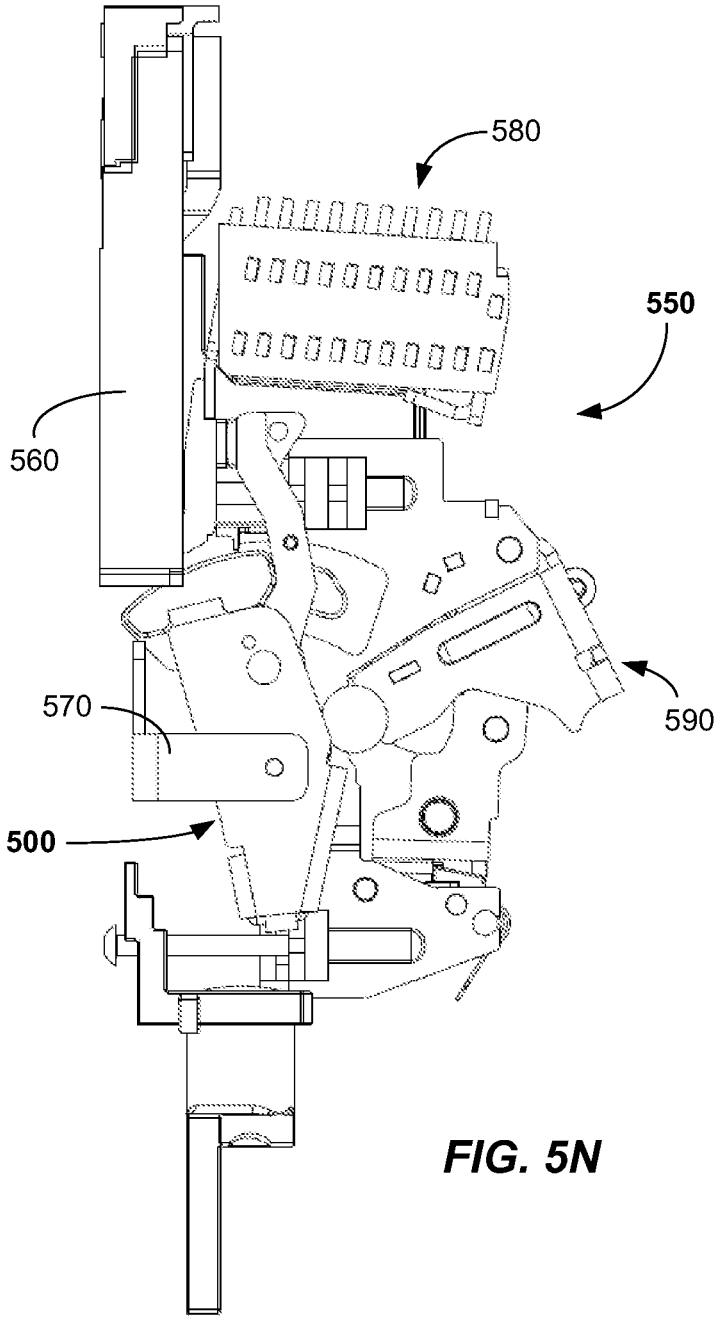
FIG. 5N is a cross sectioned side view of a circuit breaker including an electrical contact assembly mounted therein according to embodiments of the present invention.

Referring now in specific detail to FIGS. 1A-1C, an electrical contact assembly 100 is shown. The electrical contact assembly 100 will be referred to herein as a "contact assembly" or just "assembly." The electrical contact assembly 100 may be installed in a circuit breaker housing 560 of a circuit breaker 550, as shown in FIGS. 5L, 5M, and 5N, for example. The circuit breaker 550 may include multiple contact assemblies 500 (e.g., one for each electrical pole). For example, a three pole circuit breaker 550 may include three electrical contact assemblies 500 as shown in FIGS. 5B and 5L.

Again referring to FIGS. 1A-1C, each electrical contact assembly 100 may be interconnected to a load terminal via one or more flexible conductors 101. In some embodiments, the flexible conductor 101 may be one or more braided or laminated lines. The flexible conductor 101 may be connected to the first arm portion 106A, such as by braising, welding, or soldering. Other means for connection may be employed. In some embodiments, the flexible conductor 101 may be copper braided or laminated line and may connect to a load terminal for each phase.

The electrical contact assembly 100 may include a body structure such as a crossbar 102, a pivot pin 104 mounted in the crossbar 102, and one or more contact arms 106 pivotally mounted on the pivot in 104 and rotatable about a pivot axis 107 extending along a length of the pivot pin 104. The pivot pin 104 may be manufactured from a rigid material, such as steel. In some embodiments, the pivot, pin 104 may be a rivet. The crossbar 102 functions as a body to pivotally attach the contact assembly 100 to a housing of a circuit breaker 550, such as shown in FIG. 5M. The crossbar 102 may be manufactured from a suitably rigid material, such as a filled plastic or a steel sheet, and may include generally parallel first and second sidewalls 102A, 102*k* and a pocket 102C. In some embodiments, the pivot pin 104 may extend between the first and second sidewalls 102A, 102B. In the depicted embodiment, multiple contact arms 106 are pivotally mounted on the pin 104 in a side-by-side orientation. Suitable spacers (e.g., bosses on each arm 106) may maintain a proper spacing between the respective contact arms 106. Mounted on each of the contact arms 106, such as on a first arm portion 106A, is a moveable electrical contact 108M. The electrical contact 108M is spaced from the pivot axis 107 on the first arm portion 106A by a first distance. The first distance may be between about 40 mm and 60 mm, and about 54 mm in some embodiments, for example. Other first distances may be used.

Pivotally coupled to a second arm portion 106*k* of the contact arm 106, is a spring assembly 110. The spring assembly 110 pivotally connects to the second arm portion 106B by a pivoting connector at a connection location that is spaced a second distance from the pivot axis 107. The second distance may be between about 15 and 25 mm, and about 19 mm in some embodiments, for example. Other distances, may be used. Generally, the second distance is less than the first distance. Furthermore, the second arm portion 106B of the contact arm 106 may be located opposite from the first arm portion 106A of the contact arm 106 and spaced on an opposite side of the pivot axis 107.

In some embodiments, the spring assembly 110 may comprise a strut. The spring assembly 110 is coupled between the crossbar 102 and the second arm portion 106E of the contact arm 106. The spring assembly 110 may include, as shown in FIGS. 1B-1C and 3C-3H, a clevis pin 112, and a string 114 received on the clevis pin 112. The clevis pin 112 may be a cylindrical pin including an end portion 112A that is configured and adapted to be received and pivot relative to the crossbar 102.

Figure 3A:
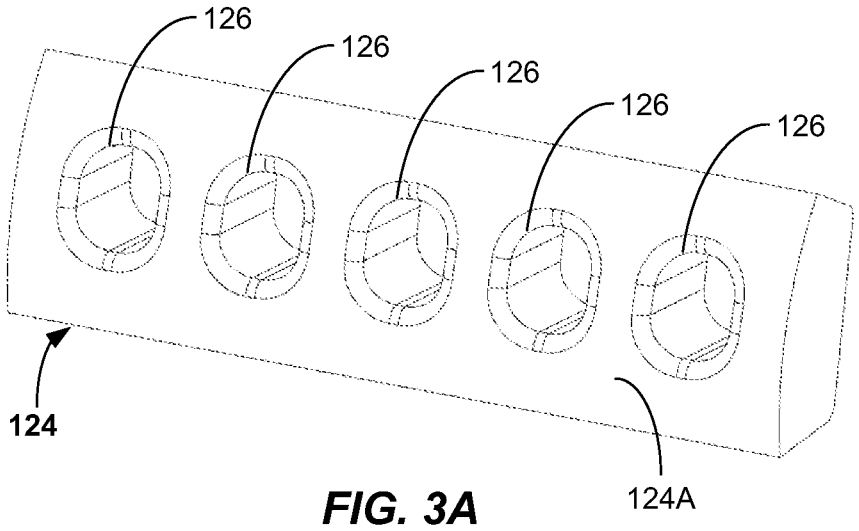
FIGS. 3A and 3B are perspective views of crossbar inserts according to embodiments of the present invention.
Figure 3B:
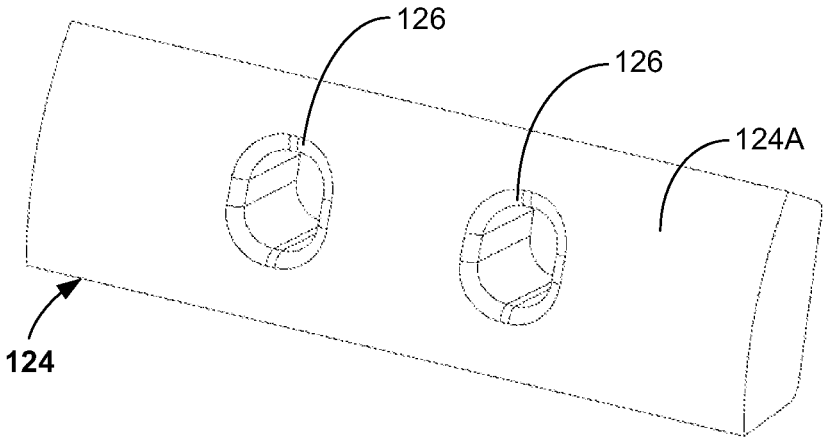

In some embodiments, the crossbar 102 may include a crossbar insert 124. In the depicted embodiment of FIGS. 1B and 1C, the spring assembly 110 couples to the crossbar 102 via the crossbar insert 124. Crossbar insert 124 may be received in the pocket 102C of the crossbar 102 or otherwise retained for rotation therein. Crossbar 124 may be fastened by screws in the pocket 102C. Representative crossbar inserts 124 are shown in FIGS. 3A and 3B. The crossbar inserts 124 are adapted to receive the ends 112A of the clevis pins 112 of spring assemblies 110 having five and two spring assemblies, respectively, in FIGS. 3A and 3B. As should be understood, electrical contact assemblies having any number of spring assemblies therein, such as one, two, three, four, five, etc. may be provided. Each respective spring assembly 110 engages the crossbar insert 124.

Specifically, each clevis pin 112 may be received in a pivot recess 126 formed in the crossbar insert 124, for example. The pivot recess 126 may be oversized (e.g., larger in dimension) as compared to an outside dimension of the clevis pin 112 at the end 112A. For example, the clevis pin 112 may include a diameter of the cylindrical portion of between about 3 mm and 5 mm, and may be about 4 mm in some embodiments. Other diameters may be used. In some embodiments, the pivot recess 126 may be elongated in one direction (See FIG. 3A-3B), such as along a direction of pivot of the clevis pin 112 in the crossbar insert 124. The elongation provides a larger dimension than the end of the clevis pin 112 along the direction of pivoting, as compared to the dimension perpendicular thereto, which may be only slightly larger than the end 1121 of the clevis pin 112. The pivoting results from tripping of the contact assembly 100 from a closed (ON) configuration (FIG. 1B) to an open (OFF) configuration (see FIG. 1C).

To minimize restriction (e.g., friction) due to pivoting of the spring assembly 110 relative to the crossbar insert 124, a curved surface 124A may be included on a portico of the crossbar insert 124 contacted by the spring 114. The crossbar insert 124 may be a cast metal, such as steel, for example. The surface of the crossbar insert 124 may also include lubrication or other low friction surface treatment thereon. In some embodiments, the structure of the crossbar insert 124 may be integral with the crossbar 102.

Figure 3C:
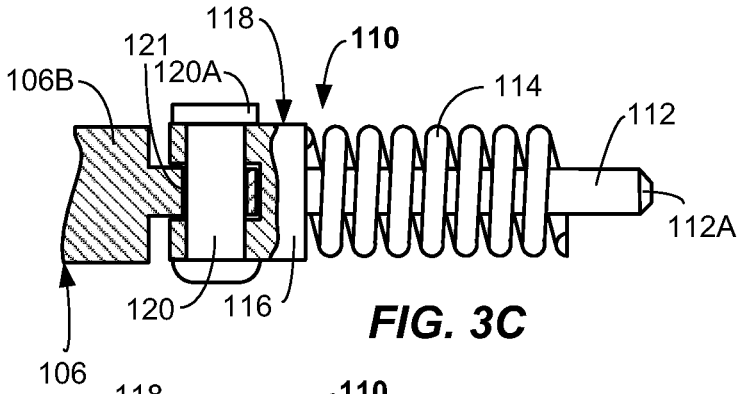
FIGS. 3C and 3D are various side views of spring assemblies including a clevis pivoting connector according to embodiments of the present invention.
Figure 3D:
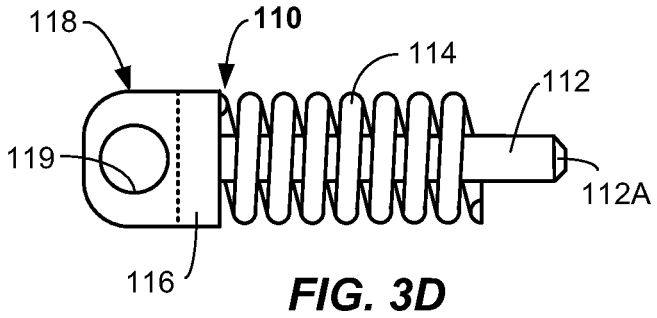
Figure 3E:
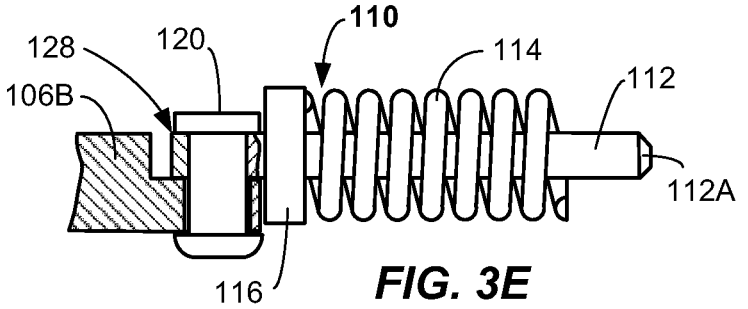
FIGS. 3E and 3F are various side views of alternative spring assemblies including a rod end pivoting connector according to embodiments of the present invention.
Figure 3F:
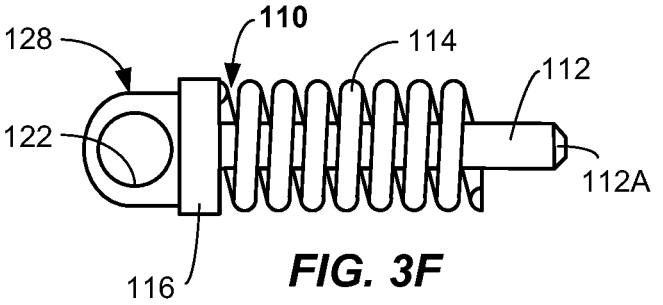

As best shown in FIG. 3G-3F, the spring assembly 110 may include a spring retainer 116 in contact with a first end of the spring 114. The spring retainer 116 may be a separate component or part of the pivoting connector of the spring assembly 110, such as part of a clevis 118 (FIG. 3C-3D) or rod end 128 (FIG. 3E-3H), as is described herein. In the depicted embodiment, the spring 114 may be a helical coil spring. The spring 114 may have a spring constant (K) of between about 8 and 75 N/mm, for example. The spring 114 may have a length between about 30 mm and 50 mm, for example. The outer diameter of the helical coil spring 114 may be between about 6 mm and 14 mm. The wire diameter of the spring 114 may be between about 1 mm and 3 mm. Other spring stiffnesses, lengths, outer diameters, and wire diameters may be used.

Other types of springs may be used and received over the clevis pin 112, such as conical springs, bellville washers, volute spring, wave springs, dome springs, etc. Table 1 below outlines various coil springs that may be used for several designs. However, in some embodiments different spring constants may be used for different springs in an assembly 101. As will be described below, certain attachments of the rod end 128 to the second arm portion 106B of the contact arm 106 may allow slightly larger spring diameters to be used. In some embodiments, use of larger springs may improve the withstand rating (maximum short time current the circuit breaker can withstand without opening the contacts) of the circuit breaker 550.

TABLE 1

| Spring Examples | | | |
|---|---|---|---|
| # Of Contact Arms | 2 | 3 | 4 |
| Contact Force (N) | 68 | 44 | 33 |
| Spring Force (N) | 263.5 | 170.5 | 129.4 |
| Coil OD (mm) | 12.2 | 10 | 7.25 |

TABLE 1-continued

| Spring Examples | | | |
|---|---|---|---|
| # Of Contact Arms | 2 | 3 | 4 |
| Wire Diameter (mm) | 2.2 | 1.8 | 1.4 |
| Free Spring Length (mm) | 39.2 | 39.5 | 39.8 |

In one embodiment, as is shown in FIGS. 3C and 3D, a first end of the spring assembly 110 includes a pivoting connector comprising a clevis 118 that is pivotally coupled to a terminal end of a second arm portion 106B of the contact arm 106 (only the end portion of the contact arm 106 shown). The pivoting connection to the second arm portion 106B may be accomplished by passing a cross pin 120 through apertures 119 formed in each of the sides of the clevis 118 and through a hole 121 formed at the terminal end of the second end portion 106B of the contact arm 106. The cross pin 120 may be of any suitable configuration. For example, in some embodiments, the cross pin 120 may be a steel rivet. In some embodiments, the cross pin 120 may be suitably press fit into the clevis 118. In some embodiments, the cross pin 120 may include a head 120A. In all embodiments, a low friction pivot connection is formed at the first end by the pin 120 received in the pivoting connector and in the hole 121 formed in the second end portion 106B of the contact arm 106.

In the depicted embodiment, the spring retainer 116 comprises the portion of the clevis 118 that connects the respective sides of the clevis 118. The dimension of the spring retainer 116 should be sufficient to allow the spring 114 to be suitably compressed between crossbar insert 124 and the spring retainer 116 upon installation. In some embodiments, a contact surface area of the spring retainer 116 in contact with the spring 114 may be at least as large as the end of the spring 114. The spring retainer 116 may comprise a planar surface contacting the first end of the spring 114. The diameter of the clevis pin 112 should be sufficient to minimize any buckling of the spring 114 in the as-compressed condition. Suitable diameters of the clevis pin are between about 3 and 8 mm. Other sizes may be used. As installed, the spring 114 may be pre-compressed between the surface of the spring retainer 116 and the crossbar insert 124 sufficiently to provide a contact force between the stationary contact 108S and the moving contact 108M of between about 25 N and 120 N. Other contact forces may be used.

In an alternative embodiment, the first end of the spring assembly 110 may include a pivoting connector comprising a rod-end 128 pivotally coupled to a terminal end of a second arm portion 106B of the contact arm 106 with a cross pin 120 as is shown in FIG. 3E. The rod end 128 may be coupled directly to the spring retainer 116. In a preferred implementation, the rod end 128 is integral with the spring retainer 116. Rod end 128 includes a rigid hoop of material surrounding the hole 122 that receives the cross pin 120. However, the spring retainer 116 and rod end 128 may be separate components in some embodiments.

FIGS. 3G-3I illustrates another embodiment of crossbar insert 324 according to embodiments of the invention. In this embodiment, the front surface that is engaged by the second end of the spring 114 comprises a pointed ridge 325 that extends along the transverse width of the crossbar insert 324. The pointed ridge 325 may be formed by the intersection of two planes 327U, 3271, formed on the upper and lower sides of the front surface 327 of the crossbar insert 324 as shown in FIG. 3I. A small radius may be provided on the ridge. Including the pointed ridge 325 may lower the pivoting resistance as the spring assembly 110 pivots from the closed (FIG. 3H) to the opened configuration (FIG. 3G).

Figure 2:
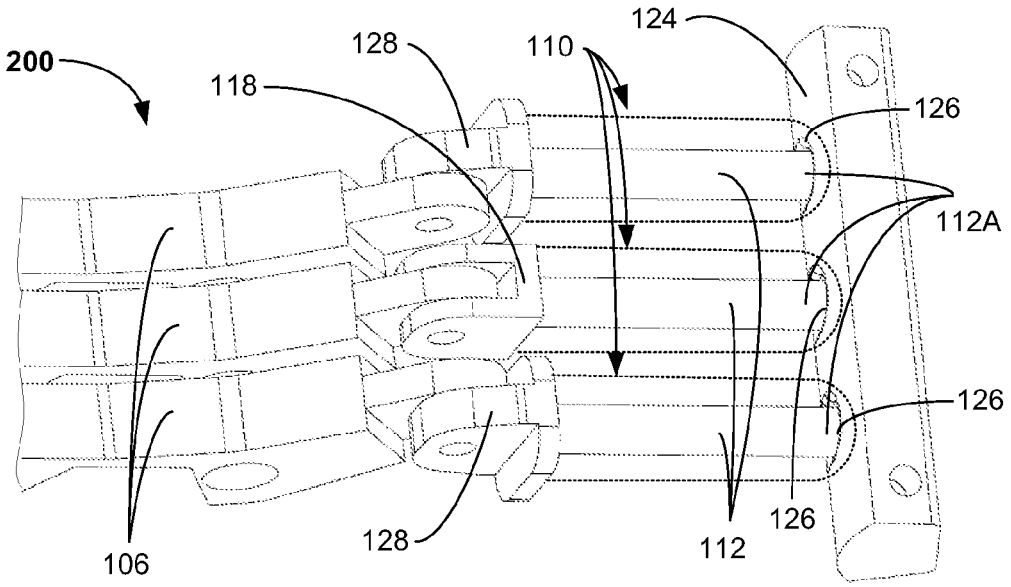
FIG. 2 is a partial perspective view of a portion of an electrical contact assembly illustrating pivoting connectors to the contact arms according to embodiments of the present invention.

As is shown in FIG. 2, one or more additional contact arms 106 may be provided and adapted for rotation on a common pivot pin of the contact assembly 200 (pin and crossbar not shown for clarity—springs shown dotted). To reduce the overall width of the contact assembly 200, combinations of spring assemblies 110 having pivoting connectors of one or more rod ends 128 and one or more clevises 118 may be provided. For example, as shown in FIG. 2 the outer two spring assemblies 110 may include pivoting connectors that are rod ends 128, whereas the center spring assembly may include a pivoting connector that is a clevis 118. Any combination of rod ends 128 and clevises 118 may be utilized. In the depicted embodiment, each of the ends 112A of the clevis pins 112 are shown inserted in the crossbar insert 124 and the ends 112A are adapted to pivot therein.

Again referring to FIG. 1A-1C, a limit pin 130 may be provided and adapted to limit a rotation motion of the contact arm 106 in a first rotational direction relative to the crossbar 102 (e.g., when in an opened configuration). The limit pin 130 may comprise a rivet and may extend between the respective sides of the crossbar 102. The limit pin 130 may extend laterally and interconnect multiple contact assemblies.

In operation, when a tripping event occurs, such as due to a current over the rated current of the phase, rotation of the moveable contact arm 106 occurs. This causes the contact arm 106 to rapidly rotate and move from a closed configuration (FIG. 1B) to a blown open configuration (FIG. 5E). Initially (in the closed configuration), a force vector FC (FIG. 1B) is oriented and directed from the crossbar insert 124 through the spring 114 and spring retainer 116 to the pivoting connection location of the spring assembly 110 to the second arm portion 106B of contact arm 106. This force vector FC is provided on a first side of the pivot axis 107. Accordingly, action of the spring assembly 110 provides a spring force to maintain the moveable and stationary contacts 108S, 108M in intimate contact and under suitable contact pressure. Upon tripping, the force vector crosses over the pivot axis 107 as the contact arm 106 moves from a closed configuration to an open configuration (FIG. 1C). In the opened configuration, as shown in FIG. 1C, the force vector FO extends from the crossbar insert 124 through the spring 114 and spring retainer 116 and through the connection of the spring assembly 110 to the contact arm portion 106B, and the force vector FO is now provided on the opposite side of the pivot axis 107. Accordingly, the spring force provided by the spring assembly 110 now holds the contact arm 106 in an open configuration. Resetting of the contact arm 106 to a closed configuration (e.g., FIG. 1B) may be provided by any suitable mechanical mechanism 590 contacting the one or more contact arms 106 to cause the one or more arms 106 to move back to the closed configuration.

Figure 4A:
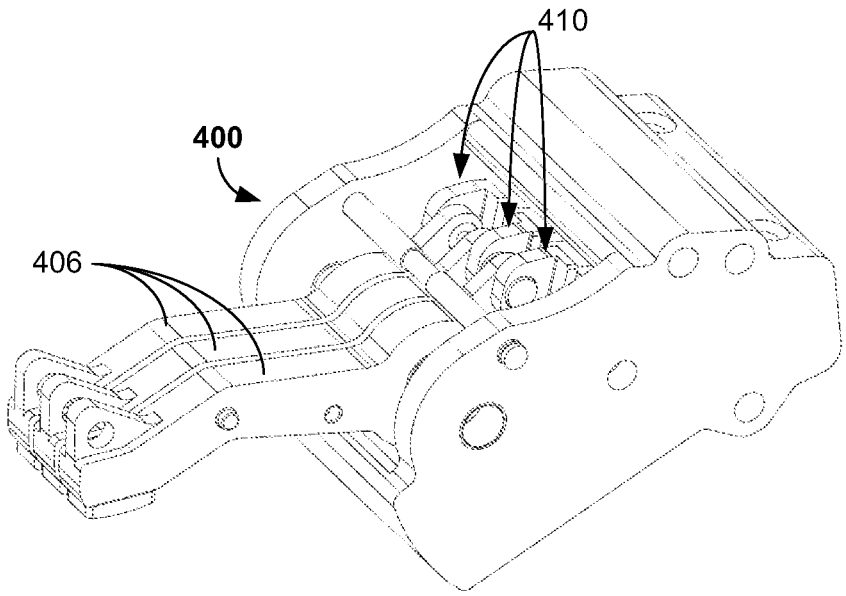
FIG. 4A is an isometric view of an alternative electrical contact assembly according to embodiments of the present invention.
Figure 4B:
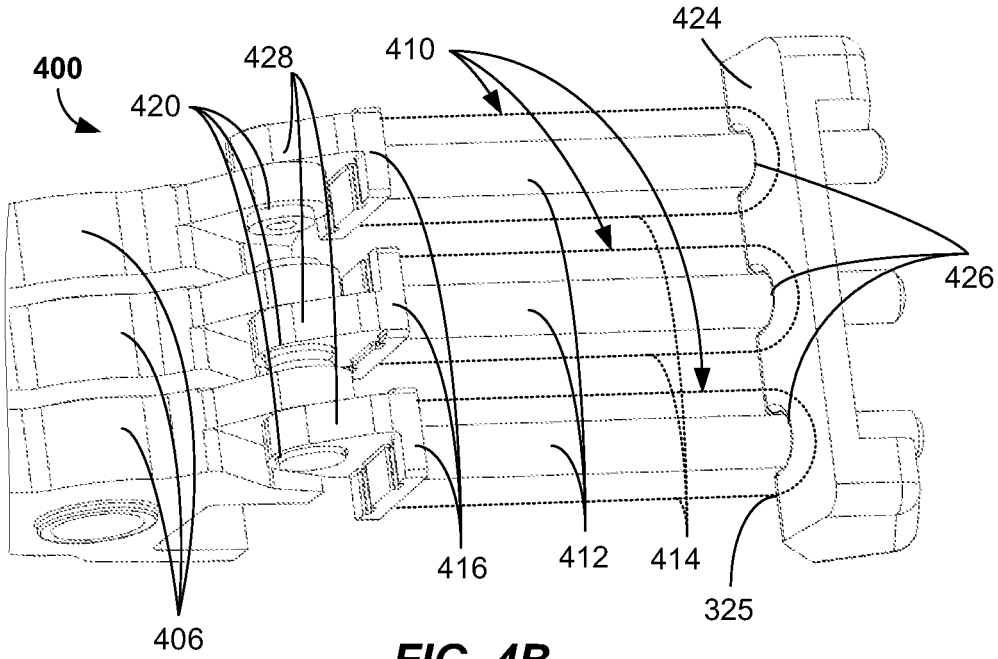
FIG. 4B is a partial isometric view of an alternative electrical contact assembly including offset rod end pivoting connectors according to embodiments of the present invention.

FIG. 4A-4B illustrates another embodiment of the electrical contact assembly 400 (only a portion shown in FIG. 4B). This embodiment is similar to the FIG. 1A embodiment, but includes spring assemblies 410 only including rod ends 428 pivotally coupled to the contact arms 406 by cross pins 120. Each rod end 128 includes an offset configuration wherein the hoop of the rod end 428 is offset laterally from an axial centerline of the clevis pin 412. This allows the spring assembly 410 to be mounted to the contact arms 406 in a number of different configurations (three different mounting configurations shown). In particular, the pivoting connector of the spring assembly 410 comprises the rod end 128 and the spring retainer 416. Providing an offset rod end 428 allows larger diameter springs to be used in the spring assemblies 410, while keeping the spacing between the contact arms 406 small. Larger springs provide greater contact forces.

FIGS. 5A-5J illustrates another alternative embodiment of the electrical contact assembly 500 and components thereof. This embodiment is similar to the FIGS. 1A-1C embodiment, except that the crossbar 502 is formed of a bent sheet material, such as steel. Furthermore, each of the spring assemblies 510 includes, rod ends 528 that are laterally offset (see FIG. 5G) from the centerline of the clevis pin 512. Such lateral offsets may allow for larger strings to be used. The string assemblies 510 pivotally couple to the contact arms 506 by way of a pin connection. Cross pins 520 are inserted through the offset rod ends 528 and may be peened for retention. Additionally, pockets 535 may be formed in the contact arms 506 and are adapted to receive (e.g., via brazing, soldering, or welding or the like) a conductor (not shown) for connecting to the load terminal. Springs 511 are pre-compressed between the crossbar insert 524 and the integral spring retainers 516 that are coupled to rod ends 528. Arc horns 540 may be provided on the ends of the contact arms 506 opposite the moveable contacts 508M. The contact assembly 500 may be pivotally mounted to the circuit, breaker housing 560 by a bracket 570, as shown in FIG. 5M, and as described further herein.

Additionally, a limit stop 530 may be provided under the contact arms 506 (as shown in FIGS. 5B, 5C-5F, and 5L-5N) and adapted to engage the contact arm 506 on the side of the contact arm 506 containing the moveable contact 508M. Providing the limit stop 530 under the contact arm 506 may allow for a lower overall profile height of the contact assembly 500. The limit stop 530 not only may limit the motion of the spring assemblies 510 and rotation of contact arms 506, but may also function as a barrier wall to minimize arcing debris from entering into a separated area 555 of the circuit breaker housing 560 from the arc chamber 558 (See FIG. 5M). As best seen in FIG. 5M, the limit stop 530 includes a curved frontal surface 530C that closely meshes with a curved surface 560C formed on the circuit breaker housing 560. For example a small gap (e.g., approx. 0.5 mm) may be provided between the curved frontal surface 530C and the curved surface 560C. Other sized small gaps may be used. In an ON configuration (see FIG. 5C) the curved frontal surface 530C is received proximate a surface (e.g., curved surface 560C) of a breaker housing 560. Upon tripping or opening, the curved frontal surface 530C moves (e.g., rotates) relative to the surface 560C of a circuit breaker housing 560. The surfaces 530C, 560C may still slightly overlap at their maximum excursions. This effectively forms a barrier wall that may operatively minimize arc debris from exiting the arc chamber 558 of the circuit breaker housing 560. Thus splattering of debris may be minimized into a separated chamber 555 containing the other components of the contact assembly 500 (e.g., pivoting connectors, spring assemblies 510, brackets 570, etc.).

Such debris, may over time impact the smooth tripping action of the circuit breaker 550. Thus, minimization of the travel of such debris splatter is desired. FIG. 5J illustrates limit stops 530 for a three-pole circuit breaker 550 wherein the three contact assemblies 500 (see FIG. 5L) are coupled together by the limit stop assembly 529. Thus, the crossbars 502 all, rotate in unison. Each limit, stop 530 is coupled to the respective crossbar 502 by screws or other fasteners received through holes and coupled (e.g., by threaded holed) to tabs 532 formed on the sides of crossbars 502 (See FIG. 5A-5B). The limit stops 530 may be made of a suitable plastic, such as the plastic used for the breaker housing 560. A reinforcing steel rod may be received through all of the limit, stops 530 and connector portions 530E (FIG. 5J).

FIGS. 5K-5N illustrates a circuit breaker 550 including a circuit breaker housing 560 that receives one or more of the electrical contact assemblies 500 therein. As best shown in FIGS. 5M and 5N, the one or more contact assemblies 500 may be pivotally attached to the housing 560 by the bracket 570. Bracket 570 is also shown in FIG. 5I. Bracket 570 includes holes 570A, 57053 that are received over pilots 536. Pilots 536 extend from the crossbar 502 on either side to allow the contact assembly 500 to pivot relative to the bracket 570, and, thus, the breaker housing 560. FIG. 5N illustrates some additional components of the circuit breaker 550, such as arc plate stack 580 and handle assembly 590 adapted to reset the circuit breaker 550 after a tripping event to the "ON" configuration or otherwise turn the circuit breaker 550 to the "OFF" configuration.

Figure 6:
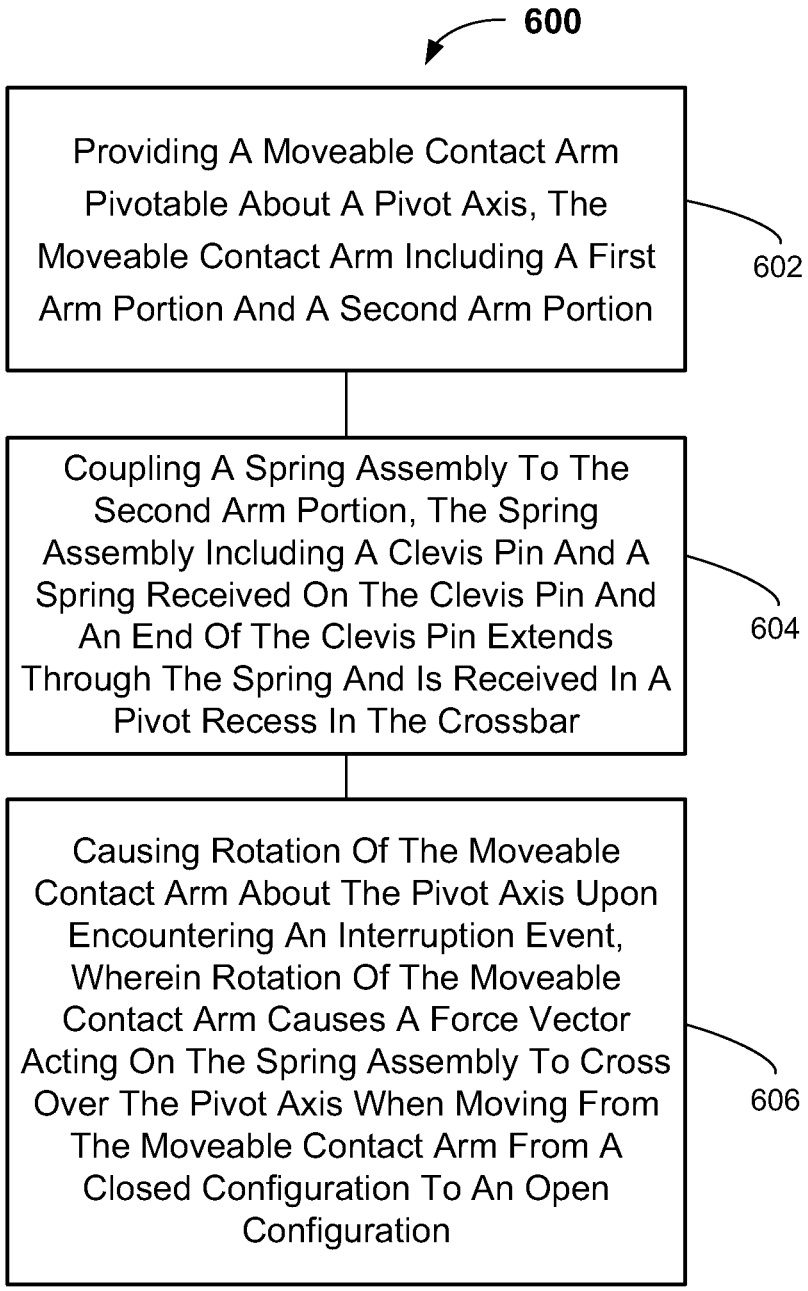
FIG. 6 is a flowchart illustrating a method of operating an electrical contact assembly according to embodiments of the invention.

FIG. 6 is a flowchart illustrating a method of operating an electrical contact assembly (e.g., 100, 400, and 500) according to an aspect of the present invention. The method 600 includes, in 602, providing a moveable contact arm (e.g., 106, 406, 506) pivotable about a pivot axis, the moveable contact arm including a first arm portion and a second arm portion, and pivotally coupling a spring assembly (e.g., 110, 410, 510) to the second arm portion in 604, wherein the spring assembly includes a spring (e.g., 114, 414, 514) and a clevis pin (e.g., 112, 412, 512) wherein an end of the clevis tin extends through the spring and is received in a pivot recess (e.g., 126, 326, 436, 526) in the crossbar. In 606, tripping forces may cause rotation of the moveable contact arm about the pivot axis upon encountering an interruption event. The rotation of the moveable contact arm causes a force vector acting on the spring assembly to cross over the pivot axis when moving from the moveable contact arm from a closed configuration to an open configuration. The first end of the spring assembly is pivotally coupled to the contact arm by a pivoting connector such as a clevis (e.g., 118) or rod end (e.g., 128, 428, 528 either offset or non-offset). Accordingly, it should be apparent that the rotation of the moveable contact arm causes smooth pivoting of the clevis pin relative to a crossbar. In a preferred embodiment, an end of the clevis pin is received in an enlarged hole of a crossbar insert. Additionally, it should be recognized that rotating the contact arm from the closed configuration to the open configuration causes variable compression of the spring of the spring assembly between a spring retainer and a curved or pointed ridge surface of the crossbar insert.

While the invention is susceptible to various modifications and alternative forms, specific embodiments and methods thereof have been shown by way of example in the drawings and are described in detail herein. It should be understood, however, that it is not intended to limit, the invention to the particular apparatus, systems, or methods disclosed, but, to the contrary, the intention is to cover all modifications, equivalents and alternatives falling within the spirit and scope of the invention.

What is claimed is:

1. An electrical contact assembly, comprising:

a crossbar;

a pivot pin mounted in the crossbar;

a contact arm pivotally mounted on the pivot pin and rotatable about a pivot axis;

a moveable electrical contact spaced from the pivot axis on a first arm portion of the contact arm; and a spring assembly coupled between the crossbar and the contact arm at a connection location spaced from the pivot axis, the spring assembly including a spring and a clevis pin wherein an end of the clevis pin opposite the connection location extends through the spring and is received in, and is pivotable in, a pivot recess in the crossbar.

2. The electrical contact assembly of claim 1, wherein the spring assembly comprises a spring retainer in contact with a first end of the spring having a dimension as large or larger than an outside dimension of the spring.

3. The electrical contact assembly of claim 1, wherein the spring comprises a coil spring having a length shorter than a length of the clevis pin.

4. The electrical contact assembly of claim 1, wherein a first end of the spring assembly comprises a clevis coupled to a terminal end of a second arm portion of the contact arm by a pin, the second arm portion of the contact arm being located opposite from the first arm portion and spaced on an opposite side of the pivot axis.

5. The electrical contact assembly of claim 1, wherein a first end of the spring assembly comprises a rod end pivotally coupled to a terminal end of a second arm portion of the contact arm with a cross pin, the second arm portion of the contact arm being located opposite from the first arm portion and spaced on an opposite side of the pivot axis wherein the rod end includes a rigid hoop of material surrounding a hole that receives the cross pin.

6. The electrical contact assembly of claim 5, comprising the rod end offset from an axial axis of the clevis pin.

7. The electrical contact assembly of claim 1, comprising one or more additional contact arms adapted for rotation on the pivot pin.

8. The electrical contact assembly of claim 7, comprising a spring assembly coupled between the crossbar and each of the one or more additional contact arms at a connection location spaced from the pivot axis, each spring assembly including a spring and a clevis pin wherein the clevis pin includes a pivoting connector pivotally coupled to the connection location with a cross pin, and wherein the clevis pin extends through the spring and is received and adapted to pivot in a pivot recess in the crossbar.

9. The electrical contact assembly of claim 1, comprising a limit stop coupled to the crossbar, the limit stop adapted to limit a rotational motion of the contact arm in a first direction, the limit stop being oriented to engage the contact arm on a first arm portion on a side of the contact arm containing the moveable electrical contact.

10. The electrical contact assembly of claim 9, wherein the limit stop includes a curved surface adapted to be received proximate a surface of a circuit breaker housing, the curved surface being moveable relative to the surface of the circuit breaker housing to operatively minimize arc debris from exiting an arc chamber of the circuit breaker housing.

11. The electrical contact assembly of claim 10, wherein the limit stop is mounted to tabs formed on sides of the crossbar.

12. The electrical contact assembly of claim 1, wherein the crossbar comprises a crossbar insert received in a pocket and adapted to receive the end of the clevis pin in the pivot recess.

13. The electrical contact assembly of claim 12, wherein the crossbar insert includes the pivot recess, and the pivot recess is elongated to include a larger dimension in a first direction than in a second direction, wherein the first direction is a pivot direction through which the clevis pin rotates in the pivot recess.

14. The electrical contact assembly of claim 12, wherein the crossbar insert includes a pointed ridge on a surface portion that extends along a transverse width of the crossbar insert, the pointed ridge contacting the spring at only two locations on opposite sides of the clevis pin.

15. The electrical contact assembly of claim 1, comprising a flexible conductor secured in a pocket of the contact arm.

16. A circuit breaker, comprising:

a circuit breaker body;

a crossbar pivotally coupled to the circuit breaker body;

a pivot pin mounted in the crossbar;

a contact arm pivotally mounted on the pivot pin and rotatable about a pivot axis;

a moveable electrical contact spaced from the pivot axis on a first portion of the contact arm; and a spring assembly coupled between the crossbar and the contact arm at a connection location spaced from the pivot axis, the spring assembly including a spring and a clevis pin wherein an end of the clevis pin extends through the spring and is received in a pivot recess in the crossbar.

17. A method of operating an electrical contact assembly, comprising:

providing a moveable contact arm pivotable relative to a crossbar about a pivot axis, the moveable contact arm including a first arm portion and a second arm portion extending in opposite directions from the pivot axis;

pivotally coupling a first end of a spring assembly to a terminal portion of the second arm portion with a cross pin, the spring assembly including a spring and a clevis pin wherein an end of the clevis pin opposite the first end extends through the spring and is received in a pivot recess in the crossbar; and causing rotation of the moveable contact arm about the pivot axis upon encountering an interruption event, wherein rotation of the moveable contact arm causes a force vector acting on the spring assembly to cross over the pivot axis when moving from the moveable contact arm from a closed configuration to an open configuration thereby causing the end of the clevis pin to pivot in the pivot recess.

18. The method of claim 17, comprising pivoting the end of the clevis pin in a crossbar insert received in a pocket.

19. An electrical contact assembly, comprising:

a crossbar;

a pivot pin mounted in the crossbar;

a contact arm pivotally mounted on the pivot pin and rotatable about a pivot axis;

a moveable electrical contact spaced from the pivot axis on a first arm portion of the contact arm; and a spring assembly coupled between the crossbar and the contact arm at a connection location spaced from the pivot axis, the spring assembly including a spring, a clevis pin including an axial axis, wherein an end of the clevis pin extends through the spring, a spring retainer coupled to the spring, and a rod end pivotally coupled to the contact arm with a cross pin, wherein the rod end includes a rigid hoop of material surrounding a hole that receives a cross pin and the rigid hoop of material is offset from the axial axis.

20. An electrical contact assembly, comprising:

a crossbar;

a pivot pin mounted in the crossbar;

a contact arm pivotally mounted on the pivot pin and rotatable about a pivot axis;

a moveable electrical contact spaced from the pivot axis on a first arm portion of the contact arm; and a spring assembly coupled between the crossbar and the contact arm, and a first end of the spring assembly coupled at a connection location spaced from the pivot axis on a second arm portion, the spring assembly including a spring, a clevis pin including an axial axis, wherein an end of the clevis pin extends through the spring and is received in, and is pivotable in, a pivot recess in the crossbar, a spring retainer on the first end coupled to the spring, and a pivoting connector coupled to the contact arm with a cross pin at the connection location; and a limit stop coupled to the crossbar, the limit stop adapted to limit a rotational motion of the contact arm, the limit stop being oriented to directly engage the first portion of the contact arm on a side of the contact arm containing the moveable electrical contact, the limit stop having a curved surface adapted to move relative to a surface of a circuit breaker housing to operatively minimize arc debris from exiting an arc chamber of the circuit breaker housing.

* * * * *